United States Patent [19]

Workman et al.

[11] 4,262,685

[45] Apr. 21, 1981

[54] BEAUTY CASE

[75] Inventors: David E. Workman, Evergeen; Robert L. Bromley, Aurora, both of Colo.; Don N. Burzen, Groton, Mass.; Judith K. McNeill, Aurora, Colo.

[73] Assignee: Samsonite Corporation, Denver, Colo.

[21] Appl. No.: 61,751

[22] Filed: Jul. 30, 1979

[51] Int. Cl.[3] ..... A45D 40/00

[52] U.S. Cl. ..... 132/79 G

[58] Field of Search ..... 132/79, 83; D3/39, 73, D3/78; 248/466–468; 190/12 R, 13 H, 49

[56] References Cited

U.S. PATENT DOCUMENTS

| | | | |
|---|---|---|---|
| D. 103,112 | 2/1937 | Lewis | D3/39 |
| D. 135,357 | 3/1943 | Botham | D3/39 |
| D. 179,783 | 2/1957 | Schwarz | D3/39 |
| 1,113,034 | 10/1914 | Miller | 248/470 |
| 1,930,244 | 10/1933 | Lewinsohn et al. | 132/79 G |
| 2,461,421 | 2/1949 | Jacobus | 132/79 G |
| 3,001,748 | 9/1961 | Austin | 248/468 |
| 4,018,237 | 4/1977 | Steiman | 132/83 R |

*Primary Examiner*—G. E. McNeil

*Attorney, Agent, or Firm*—George J. Netter

[57] ABSTRACT

There is provided a beauty case having a pair of case halves hinged together along a common edge for closing and opening. Each case half includes a metal frame edge with molded plastic shell or cover mounted thereon. An organizing tray is received within the case and disconnectably attached to the inner surface of the end walls for removal and hanging onto the front sidewall of the lower case half. A mirror is provided on the inside top surface of the upper case half which is adjustable to a different angular position and has a finger actuated latch for securing the mirror in an out of the way position against the inside cover wall. The mirror is mounted in a one-piece molded plastic frame having a flexible thin-wall section which serves as a hinge between a part of the frame secured to the inside case cover and the frame part carrying the mirror.

4 Claims, 11 Drawing Figures

BEAUTY CASE

The present invention relates generally to a luggage case, and, more particularly, to a so-called beauty case of improved construction.

SUMMARY OF THE INVENTION

In the practice of the present invention, there is provided a beauty case having a pair of case halves which are hinged together along a common edge to close and open onto one another. Each case half includes a metal frame edge with molded plastic shell or cover mounted thereon. An organizing tray is received within the case and disconnectably attached to the inner surface of the end walls enabling removal and temporary hanging relation onto the front sidewall of one of the lower case half. A mirror is provided on the inside top surface of the upper case half which is selectively adjustable to a plurality of different angular positions and further includes a finger actuated latch for securing the mirror in an out of the way position against the inside cover wall. The mirror is mounted in a one-piece molded plastic frame having a flexible thin wall section which serves as a hinge between a part of the frame secured to the inside case cover and the frame part carrying the mirror.

DESCRIPTION OF PREFERRED EMBODIMENTS

Figure 1:
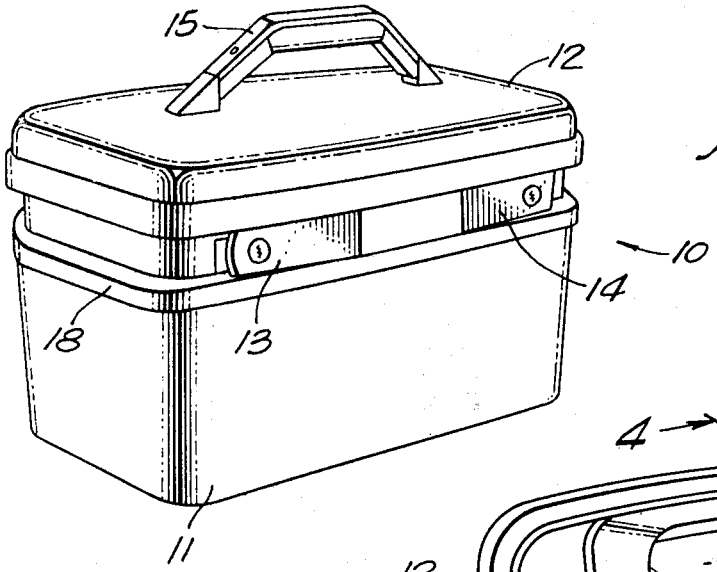
FIG. 1 is a perspective view of the beauty case of this invention shown closed.

Turning now to the drawings, and particularly FIG. 1, the beauty case of this invention is enumerated generally as at 10 and is seen to include a shell-like base 11 onto which a second shell-like member or cover 12 is received, the two being selectively engageable and releasable by manipulation of latches 13 and 14. A handle 15 is centrally located on the top wall of the cover 12 in conventional manner.

Figure 2:
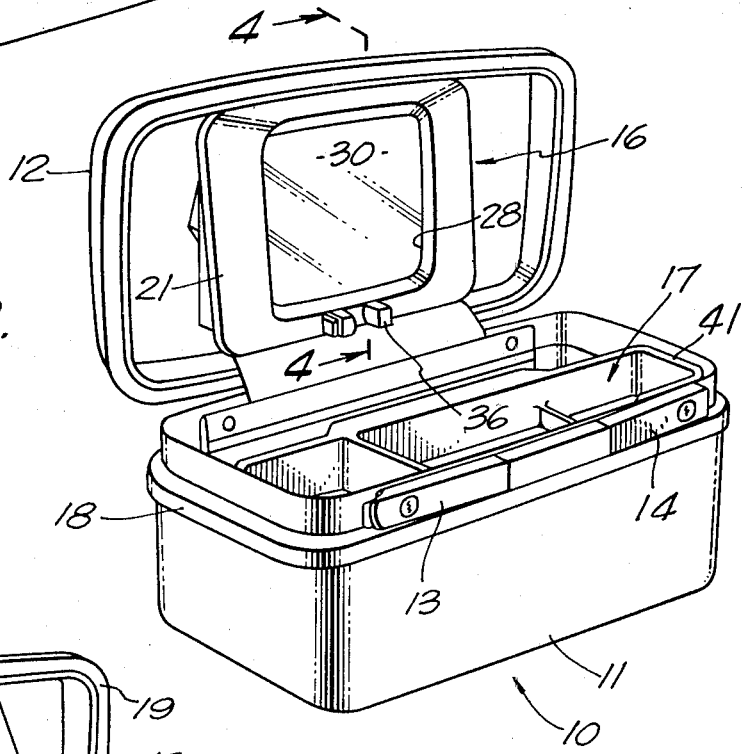
FIG. 2 is a perspective view similar to FIG. 1 showing the case open.
Figure 3:
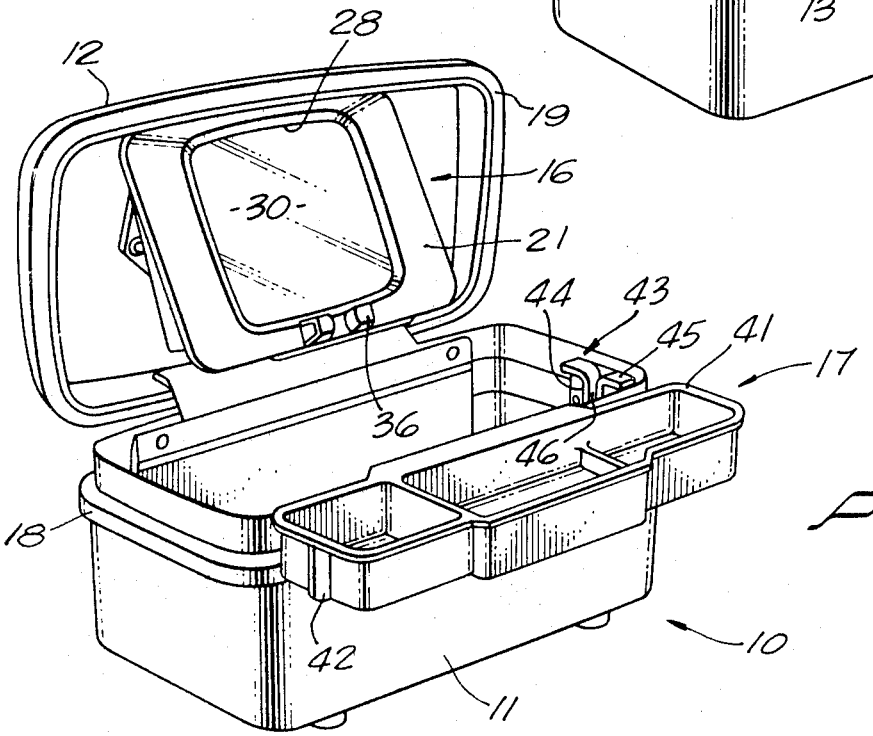
FIG. 3 is a view similar to FIG. 2 showing the organizer removed from the interior of the case and releasably secured to the case front wall.

Turning now to FIG. 2, the beauty case of FIG. 1 is shown open and seen to include on the interior surface of the cover 12 an adjustably positionable mirror assembly 16. A tray organizer 17 to be described, is releasably received within the major storage shell 11, and can be removed therefrom for releasable securement onto the front wall of the shell 11 as shown in FIG. 3. Also, as shown in these two figures, the mirror assembly 16 is adjustable from a position substantially parallel to the case cover top to a position at a considerable angle thereto.

Structurally, the shell half 11 is a deep molded plastic parallelepiped having its upper edges received within a metal frame 18 including an upstanding edge margin for fitting receipt into a channel in a similar frame on the cover 12. The cover 12 is also a molded plastic shell shallower than the shell 11.

Figure 4:
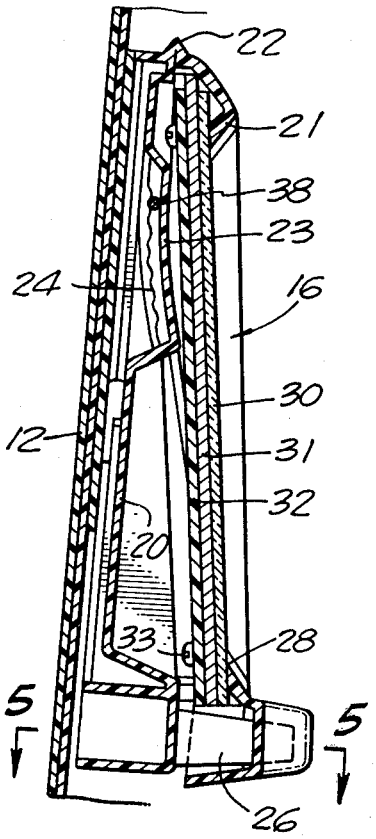
FIG. 4 is a sectional, elevational view of the mirror frame taken along the line 4—4 of FIG. 2.
Figure 6:
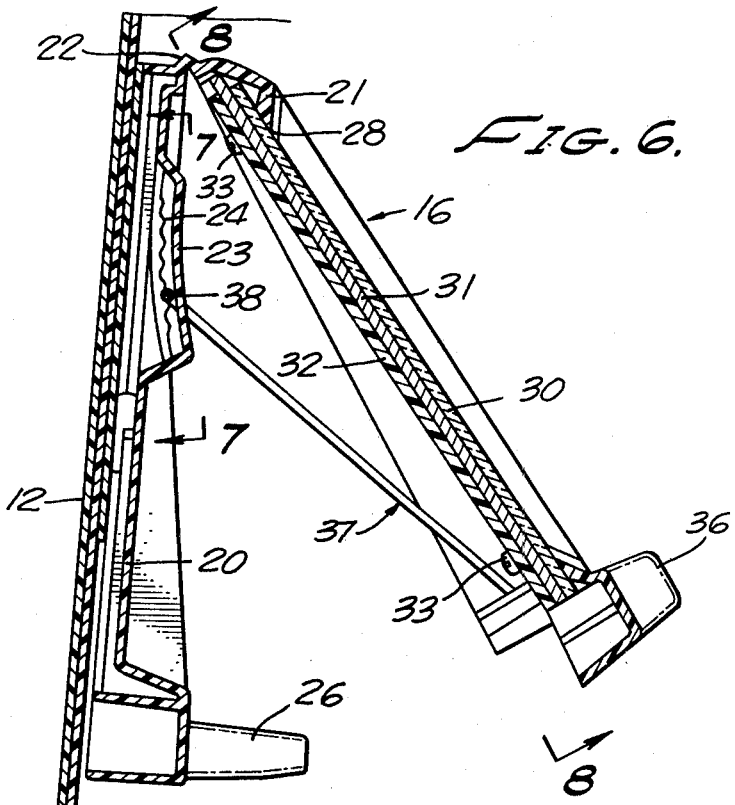
FIG. 6 is an end elevational, sectional view similar to FIG. 4 showing the mirror in extended relation.
Figure 5:
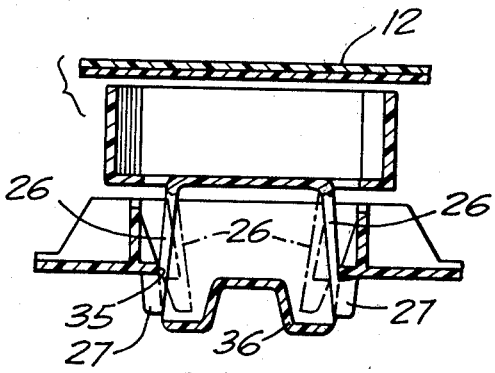
FIG. 5 is a plan sectional view taken along 5—5 of FIG. 4.

For the ensuing detailed description of the mirror assembly 16, simultaneous reference is made to FIGS. 4, 5, and 6. The assembly includes a one-piece molded plastic member 19 having a back plate 20 for securement to the beauty case cover and a mirror retaining frame 21. The back plate 20 and mirror retaining frame are interconnected along a single, thin-wall flexible section 22 of plastic integral therewith which serves as a hinge.

Figure 7:
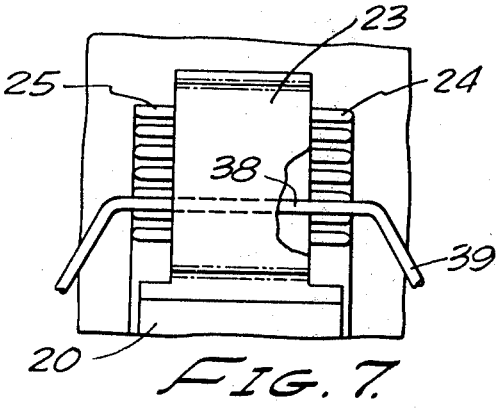
FIG. 7 is a front elevational view of the mirror adjustment support taken along 7—7 of FIG. 6.

The back plate 20 includes at a point slightly spaced from the hinge 22 a guide 23 which consists of a portion of the back plate that is formed outwardly of the major plane of the back plate and curved concavely toward the mirror retaining frame 21. As shown in FIGS. 6 and 7, the sides of the guide are open permitting access therethrough for a purpose to be described and include first and second sets 24 and 25 of raised ribs arranged in two respectively parallel lines, each line consisting of a plurality of mutually spaced ribs. As best seen in FIG. 6, the sets of ribs are arranged substantially parallel to and spaced from the guide 23 and are similarly curved concavely toward the mirror retaining frame.

On the margin of the edge opposite the hinge 22 and extending outwardly from the same side of the back plate 20 as the guide 23, are a pair of mutually spaced latching arms 26. More particularly, the arms are elongate members extending substantially normally from the back plate major surface and have sufficient inherent resiliency to enable flexing from the solid line position to the dashed line position shown in FIG. 5. The outer end portion of each latching arm includes a recessed shoulder 27 forming a hook for a purpose to be described.

The mirror retaining frame 21 is a generally rectangular member having a centrally located rectangular opening 28. The back side (i.e., the side facing the back plate 20) has four upstanding guides 29, two at each side of opening 28, for securing the edges of mirror 30 against lateral movement. A platelike cushioning member 31 (e.g., corrugated cardboard) is received over the mirror and a hard plastic sheet 32 is secured thereover by a plurality of threaded members 33. The sheet 32 and member 31 are provided with openings 34 for accommodating the upstanding guides 29.

The lower edge margin of the mirror retaining frame lying immediately opposite latching arms 26 has an opening 35 dimensioned to enable both latching arms to pass therethrough. As best seen in FIG. 5, the opening 35 is of such width that as the latching arms move through the opening they are cammed toward each other (dashed line) by the edge walls of the opening, and when received within the opening (full line depiction) the hooklike ends of the latching arms engage the opening edge walls securing the frame 21 against the back plate 20 as in FIG. 4.

The body walls defining the opening 35 form a cover 36 that extends outwardly and convexly from the mirror retaining frame front surface thereby covering the outer ends of the latching arms. The cover has open sides through which the hooklike ends of the latching arms extend slightly. To release the latching arms, they are gripped with the fingers of one hand and squeezed toward one another until they reach the dash line position at which time the retaining frame may be moved away from the backplate.

Figure 8:
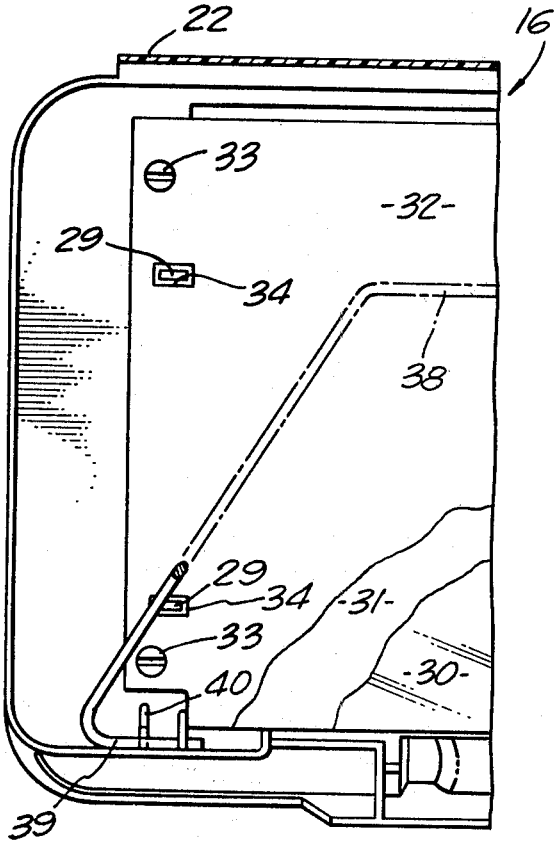
FIG. 8 is a sectional, elevational, partially fragmentary view taken along line 8—8 of FIG. 6.
Figure 9:
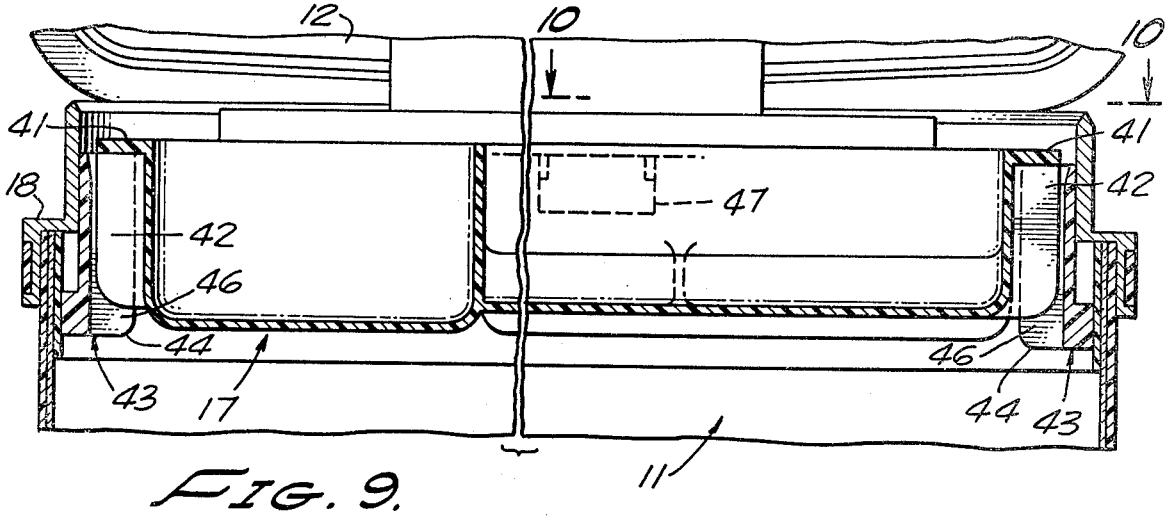
FIG. 9 is a sectional, elevational view of the organizer shown in place within the beauty case.
Figure 10:
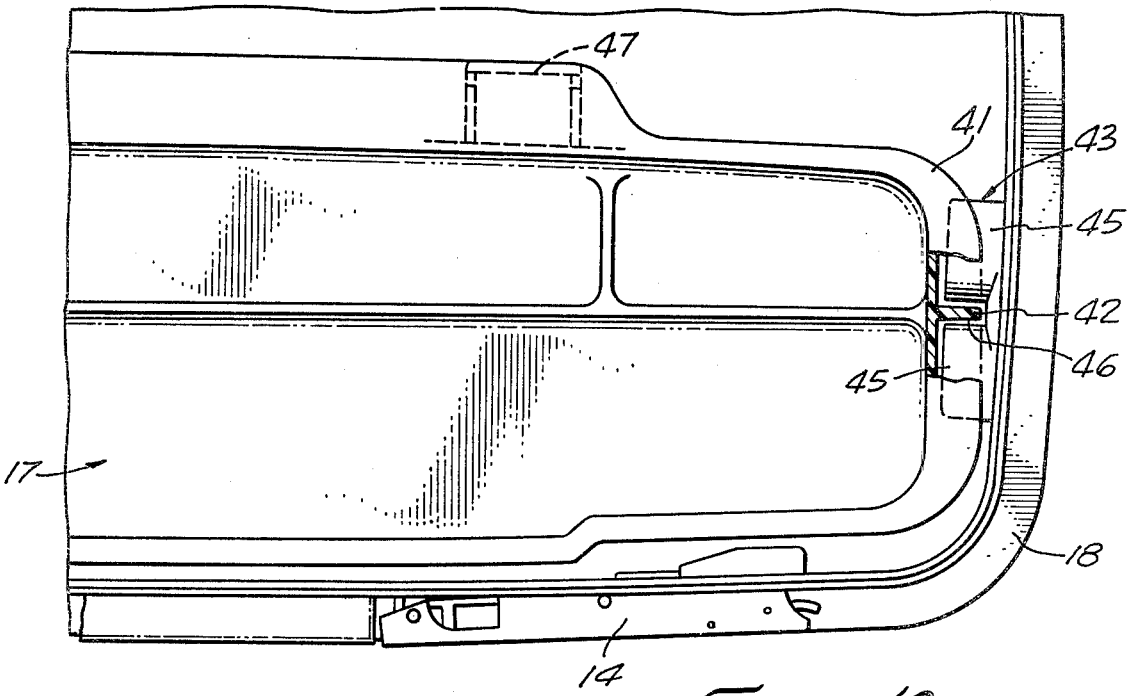
FIG. 10 is a top plan, partially fragmentary view of the organizer taken along line 10—10 of FIG. 9.

In a further aspect of the invention, a selectively adjustable brace 37 enables temporarily fixedly locating the frame 21 (and mirror) at any one of a number angular relations to the back plate (FIG. 6). The brace is a rigid wirelike rod of generally C-shape having a straightline crossbar portion 38 and end portions 39 which are formed toward each other, the latter being collinear and parallel to 38. The crossbar portion is located between the guide 23 and ribs 24 and 25 (FIGS. 6 and 7) on the back plate and the brace end portions 39 are rotatably received within openings on upstanding wall members 40 on the back side of the retaining frame (FIG. 8). The diameter of the brace rod crossbar is such as to be in continuous resiliently urging contact with the guide 23 (FIG. 6).

For the ensuing description of use of the mirror, assume the beauty case is open as in FIG. 2 and the mirror retaining frame is temporarily locked to the back plate as in FIG. 4. First, the mirror retaining frame is released from the back plate by finger actuation of the ends of the latching arms to the dashed line position at which time the springlike characteristics of the material adjacent the hinge 22 (which are in compression when the mirror assembly is closed) urge the retaining frame away from the back plate. The retaining frame is then positioned angularly about the hinge 22 until the mirror is in a convenient position. During this angular adjustment the brace crossbar 38 snaps in and out of the spaces between adjacent ribs of 24 and 25 with the springlike action of the guide 23 serving to maintain adjustment position until it is affirmatively changed. The curve applied to the sets of ribs (FIGS. 4 and 6) makes it easier to change adjustment over, say, an arrangement of ribs in the plane of the back plate where the brace would have a tendency to become jammed since removal forces would be closer to the normal.

In a still further aspect, the beauty case includes a tray organizer 17 which is optionally removably carried within the case or attachable to the case front side wall. The organizer is an elongated, open-top dishlike member having internal upstanding walls defining a plurality of separate compartments. A continuous rim 41 extends outwardly of the organizer completely about the periphery. On each outer end wall there is provided a vertically extending fin 42 meeting the rim in a general T-shape. First and second mounting brackets 43 are affixed to the respective case inner end wall and have walls 44 extending inwardly defining a substantially horizontal supporting surface 45 and a vertical groove 46. The bracket dimensions are such that both fins 42 can be received within the respective grooves 46 with the rim parts adjacent the fins resting on the surface 45 thereby temporarily and removably storing the organizer within the case.

Figure 11:
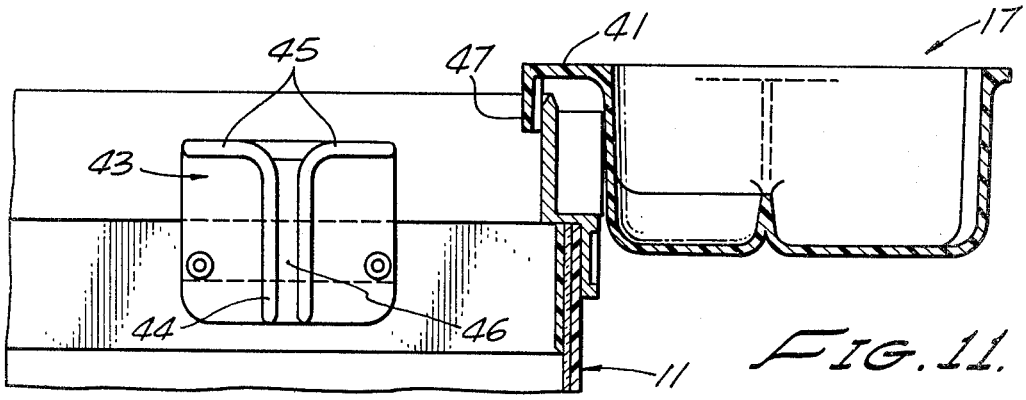
FIG. 11 is an end elevational, sectional view showing the organizer externally located on the front of the beauty case.

A pair of downwardly directed extensions 47 of the organizer rim are formed spaced from the organizer side wall. The spacing arrangement is such as to enable the extensions to be slipped onto the case front edge wall as in FIG. 11 holding the organizer to the front case wall for an optional mode of use.

We claim:

1. A beauty case having an open-top, shell-like base with a cover hingedly received thereon, comprising in combination:

a mirror assembly including a backplate integrally connected to an angularly adjustable mirror-carrying frame via a continuous thinwall flexible hinge, said backplate being affixed to an inside surface of the cover;

a plurality of mutually spaced raised ribs and a spaced overlying guide, and a brace having first portions thereof located between the guide and ribs and other brace portions being pivotally interconnected with said mirror-carrying frame, said brace first portions being resiliently clamped by the guide when said brace is located in an intervening space between two adjacent ribs; and an organizing tray removably mounted onto brackets secured to opposite walls of the shell-like base.

2. A beauty case as in claim 1, in which the mirror assembly backplate includes a pair of spaced flexible latching arms each having a hook, which arms are received through an opening in the mirror-carrying frame when said bracket is adjusted against the backplate with the latching arm hooks engaging walls defining the frame openings.

3. A beauty case having an open-top, shell-like base with a cover hinged thereover, comprising in combination:

a mirror assembly including a backplate integrally connected to an angularly adjustable mirror-carrying frame via a continuous thinwall flexible hinge, said backplate being affixed to an inside surface of the cover, and including a pair of spaced flexible latching arms each having a terminal hook, which arms are received through an opening in the mirror-carrying frame when said bracket is adjusted against the backplate with the latching arm hooks engaging walls defining the frame openings; and a plurality of mutually spaced raised ribs and a spaced overlying guide, and a brace having first portions thereof located between the guide and ribs with other brace portions being pivotally interconnected with said mirror-carrying frame, said brace first portions being resiliently clamped by the guide when said brace is located in an intervening space between two adjacent ribs;

said raised ribs being parallel to each other and arranged along a line extending transversely of the ribs which line is curved concavely toward the mirror-carrying frame, and the guide is similarly curved parallel to said ribs; and an organizing tray removably mounted onto brackets secured to opposite walls of the shell-like base.

4. A beauty case as in claim 3, in which the backplate, mirror-carrying frame and flexible hinge are of one-piece molded plastic construction.

* * * * *